US005172166A

United States Patent [19]

Funayama

[11] Patent Number: 5,172,166

[45] Date of Patent: Dec. 15, 1992

[54] DEVELOPING APPARATUS

[75] Inventor: Naotaka Funayama, Yamato-Koriyama, Japan

[73] Assignee: Sharp Kabushiki Kaisha, Osaka, Japan

[21] Appl. No.: 724,424

[22] Filed: Jul. 2, 1991

[30] Foreign Application Priority Data

Jul. 9, 1990 [JP] Japan ..... 2-182240

[51] Int. Cl.[5] ..... G03G 21/00

[52] U.S. Cl. ..... 355/215; 355/253; 118/658; 118/661

[58] Field of Search ..... 355/215, 251, 253, 259, 355/245; 118/651, 653, 657, 658, 661

[56] References Cited

U.S. PATENT DOCUMENTS

| | | | |
|---|---|---|---|
| 3,809,012 | 5/1974 | Delvecchio | 118/637 |
| 4,213,617 | 7/1980 | Salger | 355/215 X |
| 4,676,192 | 6/1987 | Yuge et al. | 118/658 |
| 5,057,868 | 10/1991 | Sekino et al. | 355/215 |
| 5,084,733 | 1/1992 | Katoh et al. | 355/251 |

FOREIGN PATENT DOCUMENTS

| | | |
|---|---|---|
| 60075854 | 9/1983 | Japan . |
| 0239074 | 7/1988 | Japan . |

*Primary Examiner*—A. T. Grimley
*Assistant Examiner*—P. Stanzione
*Attorney, Agent, or Firm*—David G. Conlin; Henry D. Pahl, Jr.

[57] ABSTRACT

A developing apparatus capable of preventing a leakage of developing powder from being placed on photoconductor of a copying machine, the developing apparatus having a doctor for restricting an amount of developing powder to be placed on said photoconductor of the copying machine includes a unit for storing a developing powder, a roller having a sleeve and a magnet and rotationally supported on the storing unit for laminating the developing powder output from the storing unit on the sleeve in accordance with a magnetic force of the magnet, and a unit for preventing the developing powder from being leaked to a non-imaging area located at end portions of the roller, the preventing unit being located in a upstream side of the storing unit and being so arranged that an interval between the preventing unit and the roller is larger than an interval between the doctor and the roller.

11 Claims, 5 Drawing Sheets

DEVELOPING APPARATUS

BACKGROUND OF THE INVENTION

1. Field of the Invention

The present invention relates to a developing apparatus which is adapted to be used for a copying machine or a printer employing an electrophotographic technique.

2. Description of the Related Art

The inventors of the present invention know that there is a developing apparatus which includes a developing bath, a toner feeding bath, and a partition plate provided between the developing bath and the toner feeding bath. The developing bath is located closer to a photoconductor provided in a copying machine, and the toner feeding bath stores magnetic toner for feeding it to the developing bath. The partition plate provides a toner outlet for communicating the developing bath with the toner feeding bath.

The developing bath provides a developing roller rotationally supported on the developing apparatus itself and a doctor for restricting an amount of developing powder (toner and carrier) attracted on the developing roller. The developing roller has a sleeve and a magnet located inside of the sleeve, the sleeve serving to rotate in an opposite direction to the rotation of the photoconductor and the magnet serving to rotate in an opposite direction to the sleeve.

The toner feeding bath provides a toner stirring roller for stirring magnetic toner and feeding the magnetic toner into the developing bath through the toner outlet.

In operation, the developing powder stored in the developing bath is conveyed for development to the photoconductor provided in the copying machine through the effect of the rotations of the sleeve and the magnet provided in the developing roller as the amount of the developing powder attracted on the sleeve is restricted by the doctor.

Since the magnet is not long enough to reach both ends of the developing roller, the magnetic attraction is so weak at the end portions of the developing roller that the developing powder is thrown off the developing roller through the effect of the developing roller itself, resulting in causing leakage of the developing powder from both end portions of the developing roller.

In order to block the leakage, there is also provided a block portion for preventing the developing powder from being leaked out as well as a sealing material made of suede located between the developing roller and the block portion and the bottom wall of the developing bath in a manner to allow the sealing material to come in contact with the surface of the developing roller.

The above-mentioned developing apparatus will be described with reference to FIGS. 1 to 4 in the followings.

In FIG. 1, a photoconductor 11 provided in a copying machine is shown. The developing apparatus having a developing bath 12 is so arranged that magnetic toner 13 is stored in a toner feeding bath 14 and a partition plate 15 is provided between the developing bath 12 and the toner feeding bath 14.

The developing bath 12 is located closer to a photoconductor 11, and the toner feeding bath 14 feeds magnetic toner 13 stored therein to the developing bath 12. The partition plate 14 provides a toner outlet 16 for communicating the developing bath 12 with the toner feeding bath 14.

The developing bath 12 provides a developing roller 18 rotationally supported on the developing apparatus itself and a doctor 20 for restricting the amount of developing powder (toner and carrier) 19 attracted on the developing roller 18.

As shown in FIG. 2, the developing roller 12 has a sleeve 21 and a magnet 22 located inside of the sleeve 21. The sleeve 21 serves to rotate in an opposite direction with respect to a rotation of the photoconductor 11 and the magnet 22 serves to rotate in an opposite direction with respect to a rotation of the sleeve 21.

The toner feeding bath 14 provides a toner stirring roller 23 for stirring magnetic toner 13 and feeding the magnetic toner 13 into the developing bath 12 through the toner outlet 16.

In operation, the developing powder 19 stored in the developing bath 12 is conveyed for a development to the photoconductor 11 provided in the copying machine through the effect of the rotations of the sleeve 21 and the magnet 22 provided in the developing roller 18 as the amount of the developing powder attracted on the sleeve 21 is being restricted by the doctor 20.

Since the magnet 22 is not long enough to reach both ends of the developing roller 18, the magnetic attraction is so weak at the end portions of the developing roller 18 that the developing powder 19 is thrown off the developing roller 18 through the effect of the developing roller 18 itself, and it results in causing a leakage of the developing powder 19 from both end portions of the developing roller 18.

In order to block the leakage of the developing powder 19 as shown in FIGS. 3 and 4, there is also provided a block portion 24 for preventing the developing powder 19 from being leaked out as well as a sealing material 25 made of suede located between the developing roller 18 and the block portion 24 and the bottom wall of the developing bath 12 in a manner to allow the sealing material 25 to contact with the surface of the developing roller 18.

However, the suede-made sealing material 25 has the following disadvantages. It may provide variable pressure on the developing roller 18 and its woolen surface may be stripped off as a result of long-time rotation of the developing roller 18. These disadvantages result in making the sealing effect unstable, thereby causing a leakage of the toner out of both end portions of the developing roller 18. That is, the toner is spilt out of the developing apparatus.

Further, since the split toner is circulated on the powder-laminated surface of the developing roller 18, a fog phenomenon may take place on the edges of the resulting image.

In the above-mentioned developing apparatus, when the toner on the sleeve 21 meets the sealing member, that is, the obstacle to the circumferential movement of the sleeve 21, the longitudinal rotation (perpendicular to the circumferential direction) is applied to the circumferential rotation of the toner, resulting in moving the toner in the longitudinal direction and thereby leaking the toner out of the ends of the developing roller 18.

SUMMARY OF THE INVENTION

It is therefore an object of the present invention to provide a developing apparatus which is adapted to prevent a leakage of a developing powder.

The object of the present invention can be achieved by a developing apparatus capable of preventing a leakage of developing powder from being placed on photoconductor of a copying machine, the developing apparatus having a doctor for restricting an amount of developing powder to be placed on the photoconductor of the copying machine, the developing apparatus includes a unit for storing a developing powder, a roller having a sleeve and a magnet and rotationally supported on the storing unit for laminating the developing powder output from the storing unit on the sleeve in accordance with a magnetic force of the magnet, and a unit for preventing the developing powder from being leaked to a non-imaging area located at end portions of the roller, the preventing unit being located in a upstream side of the doctor of the storing unit and being so arranged that an interval between the preventing unit and the roller is larger than an interval between the doctor and the roller.

Preferably, the storing unit has walls and the preventing unit has a surface made of a magnetic material so that a magnetic force of constraint inhibits a movement of the developing powder to the walls of the storing unit.

More preferably, the surface of the preventing unit includes an iron plate attached thereon for magnetizing the surface.

The developing device further includes a toner feeding bath disposed adjacent to the storing unit and a toner outlet for communicating the storing unit with the toner feeding bath, preferably.

The developing device further includes a stripping member between the toner outlet and the doctor, the stripping member serving to strip the developing powder on the sleeve, preferably.

The developing device further includes a first stirring area defined by the stripping member and the sleeve, the stirring area being so arranged that the stripped developing powder and magnetic toner are stirred therein for mixing the stripped developing powder and the magnetic toner, the magnetic toner being newly fed from the toner feeding bath through an effect of a circular flow caused by the magnet, preferably.

The developing device further preferably includes a second stirring area defined by the doctor and sleeve, the second stirring area serving to cause a circular flow directed to the stripping member along a rotation of the sleeve through an effect of the magnetic force of the magnet and a rotation of the sleeve.

The stripping member preferably has an L-shape portion, one of the L-shape portion being bent toward the roller and located in a rotation downstream side of the sleeve more than the toner outlet and before the doctor.

The other one of the L-shape portion of the stripping member is preferably bent so that a bent end thereof is mounted on the developing apparatus at a lower portion of the toner outlet.

The one of the L-shape portion is a stripping portion for stripping the developing powder from the roller, preferably.

Preferably, the interval between the stripping portion and the sleeve is $0.7 \pm 0.1$ mm and the interval between the doctor and the roller is $0.3 \pm 0.02$ mm.

More preferably, the storing unit is a developing bath.

Further preferably, the roller is a developing roller.

The preventing unit is preferably an inhibiting member.

In the operation of the developing apparatus according to the present invention, the inhibiting member serves to stop supply of the developing powder to the sleeve around both end portions, that is, non-imaging areas of the developing roller. Hence, the developing powder is not left laminated on the sleeve. Further, since the inhibiting member is left out of contact with the sleeve, the developing powder is not allowed to move in the longitudinal direction of the developing roller. The rotation of the magnet, however, causes toner to be a bit dispersed onto the developing roller. The thickness of the attracted toner is far smaller than the interval between the sleeve and the photoconductor provided in a copying machine, for example, to which the present developing apparatus applies. No toner is, therefore, attracted on the photoconductor, resulting in never giving dirt onto the resulting image.

That is, the developing powder attracted on the sleeve is moved in the circumferential direction through the effect of the magnet. Further, no obstacle is provided for preventing the circumferential movement of the developing powder, resulting in moving no developing powder longitudinally around the end portions of the developing roller and preventing the developing powder from being leaked outside.

Furthermore, on a portion of the magnet of the developing roller being overlapped with the magnet, the developing powder is strongly constrained by lines of magnetic force directed from the magnet to the magnet. Hence, when the developing apparatus is fallen or shaken in transportation in the state that the developing powder is filled in the developing bath, the force of constraint given by the magnet serves to stop the movement of the developing powder toward the side wall of the developing bath against the pressure applied by the developing powder from the inside of the developing bath.

Further objects and advantages of the present invention will be apparent from the following description of the preferred embodiments of the invention as illustrated in the accompanying drawings.

DESCRIPTION OF THE PREFERRED EMBODIMENTS

Referring to accompanying drawings, preferred embodiments of the developing apparatus of the present invention will be described.

A developing apparatus according to a first embodiment of the present invention will be described with reference to FIGS. 5 to 10.

The same components as shown in the FIGS. 1 to 4 are referred by the same reference numbers for a convenience.

Figure 1:
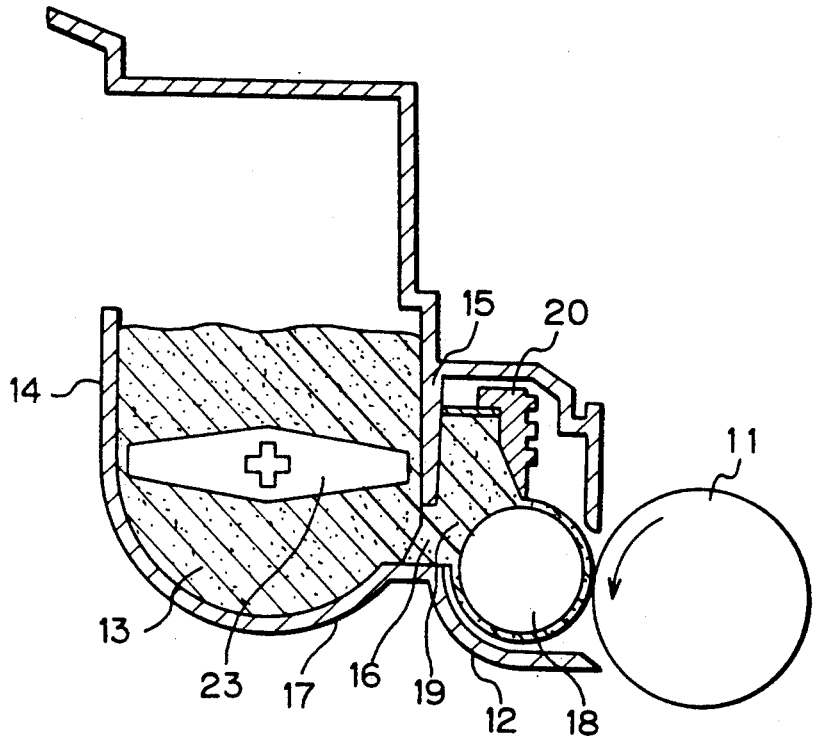
FIG. 1 is a sectional view showing a known developing apparatus by the inventors of the present invention.
Figure 2:
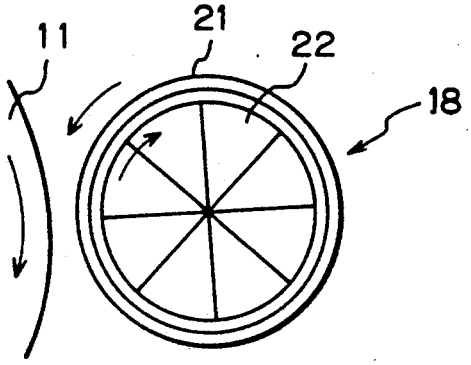
FIG. 2 is a view showing the rotation of a developing roller and a photoconductor included in the known developing apparatus shown in FIG. 1.
Figure 3:
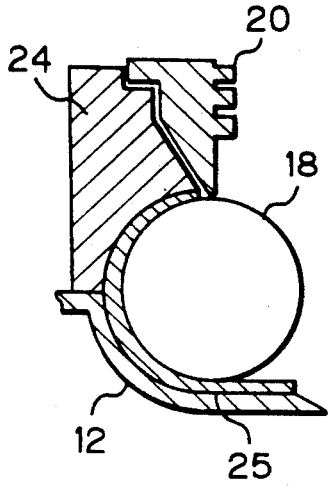
FIG. 3 is a sectional view showing a developing bath included in the known developing apparatus shown in FIG. 1.
Figure 4:
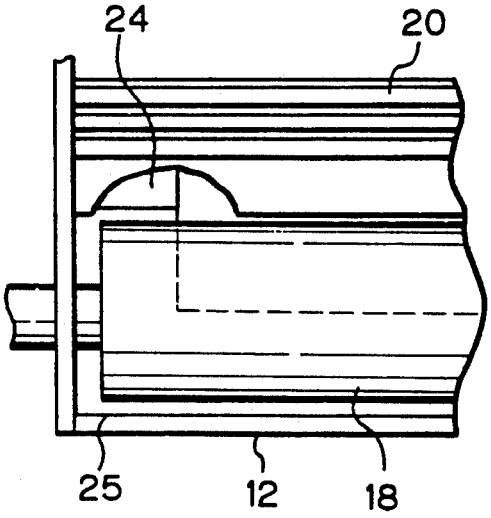
FIG. 4 is an elevation view showing the developing bath of FIG. 3.
Figure 5:
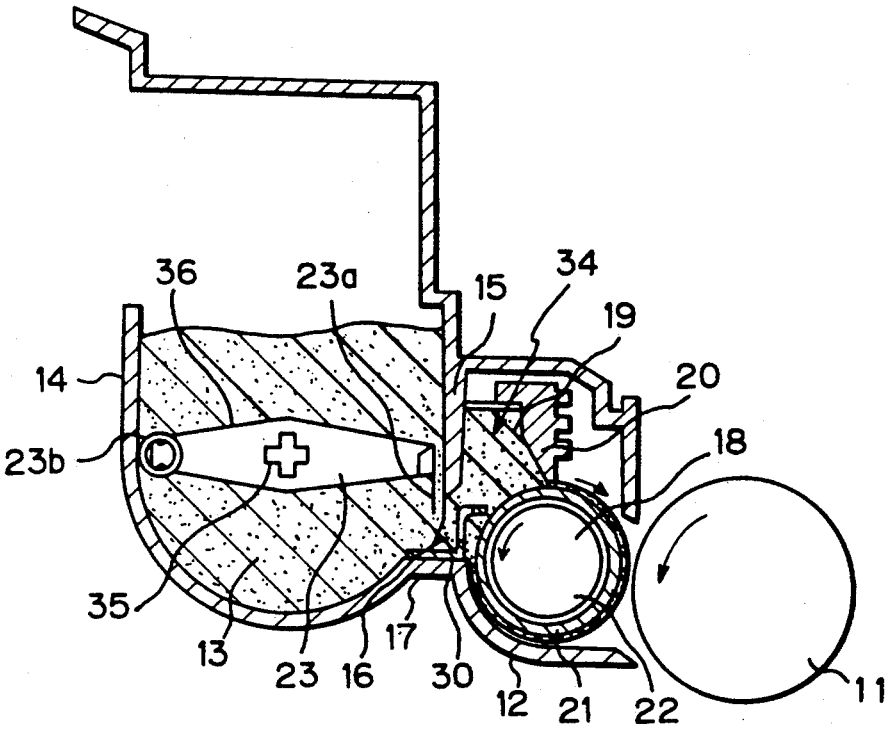
FIG. 5 is a sectional view showing a developing apparatus according to a first embodiment of the present invention.

In FIG. 5, the developing apparatus includes a developing bath 12, a toner feeding bath 14 and a doctor 20. The developing bath 12 provides a developing roller 18 composed of a sleeve 21 and a magnet 22 being rotationally operated.

The toner feeding bath 14 stores a magnetic toner 13 for feeding the magnetic toner 13 to the developing bath 12. The doctor 20 serves to restrict the amount of the developing powder 19 attracted on the sleeve 21.

Figure 6:
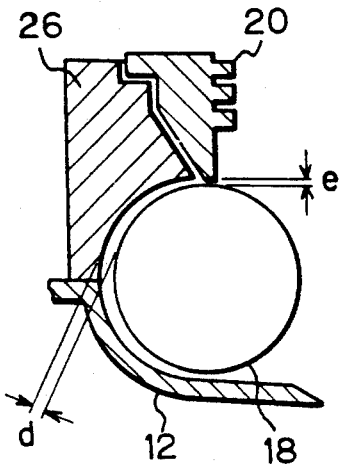
FIG. 6 is a sectional view showing a developing bath included in the developing apparatus of FIG. 5.
Figure 7:
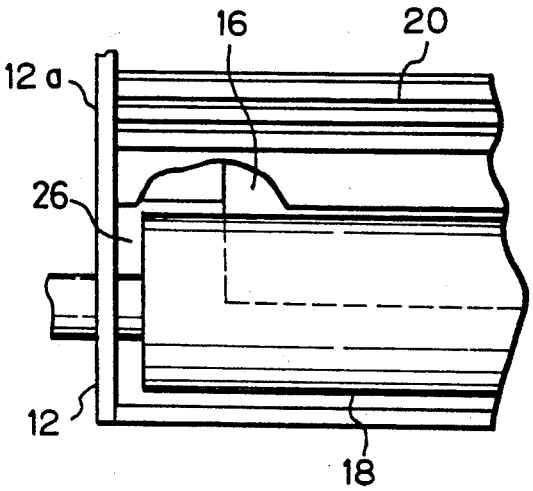
FIG. 7 is an elevation view showing the developing bath of FIG. 6.

As shown in FIGS. 6 and 7, there is provided an inhibiting or preventing member 26 for preventing a leakage of developing powder 19 at the non-imaging areas C located at both end portions of the developing roller 18 and in the upstream side of the doctor 20. It is assumed that an interval d between the inhibiting member 26 and the developing roller 18 is larger than an interval e between the doctor 20 and the developing roller 18.

The magnetic toner 13 is toner containing magnetic iron oxide. The developing powder 19 is composed of a mixture of the magnetic toner 13 and carrier containing ferrite, iron powder, or magnetic iron oxide granulation carrier.

Figure 8:
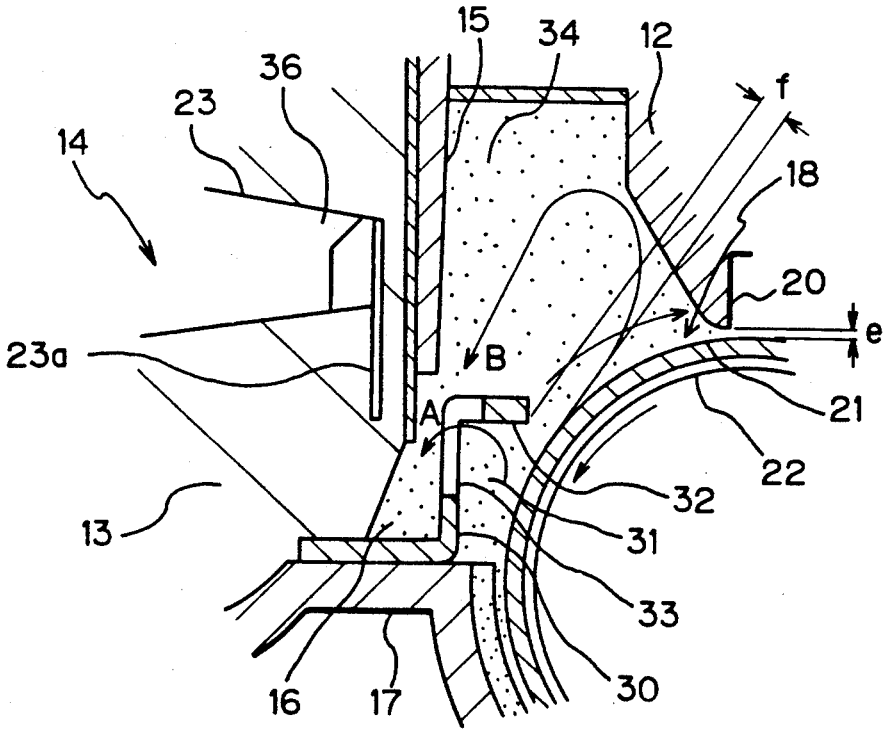
FIG. 8 is an expanded section showing an essential portion of the developing apparatus shown in FIG. 5.
Figure 9:
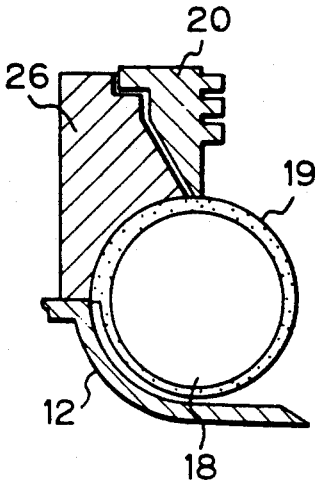
FIG. 9 is a sectional view showing a developing bath having a developing roller on which the developing powder is laminated.

As shown in FIGS. 8 and 9 in detail, between the doctor 20 and the toner feeding port 16 communicating the toner feeding bath 14 with the developing bath 12, there is located a stripping member 30 for stripping off the developing powder 19 attracted on the sleeve 21. The stripping member 30 is located closer to the developing roller 18.

The stripping member 30 provides a stirring area 31 formed thereon. The stirring area 31 serves to mix and stir the magnetic toner 13 fed from the toner feeding bath 14 and the developing powder 19 stripped by the stripping member 30 for keeping the toner density of the developing powder 19 constant.

The stripping member 30 has an L-shape section. One end portion of the member 30 is bent toward the developing roller 18. This bent end is referred to as a stripping portion 32. The other end portion of the member 30 is bent so that the bent end is mounted on the developing apparatus 17 itself. The mounting location is a lower portion of the toner outlet 16.

The stripping portion 32 is located in the rotation downstream side of the sleeve 21 rather than the toner outlet and before the doctor 20. It is assumed that the thickness f between the stripping portion 32 and the sleeve 21 is $0.7\pm0.1$ mm and the interval e between the doctor 20 and the sleeve 21 is $0.3\pm0.02$ mm.

The stirring area 31 means an area defined by the stripping portion 32, the sleeve 21, and an opening 33 formed on the stripping member 30 for communicating the toner outlet 16 with the developing roller 18.

The developing powder 19 stripped off the sleeve 21 by the stripping portion 32 flows in the direction of a circulating current A. Along the flow, the developing powder 19 is mixed and stirred by the magnetic toner 13 attracted from the toner outlet 16 through the opening 33 through the effect of the magnetic force of the magnetic 22.

Between the stripping member 30 and the doctor 20, a second stirring area 34 is formed for stirring the developing powder 19 restricted by the doctor 20 in a manner to direct the developing powder 19 toward the stirring area 31. The stripping member 30 is closer to the toner outlet 16 in a manner to allow the developing powder 19 circularly flown by the second stirring area 34 to be mixed with the developing powder 19 stripped by the stripping member 30.

The second stirring area 34 means an area defined by the doctor 20, the sleeve 21, and the partition plate 15. The developing powder 19 restricted by the doctor 20 is circularly flown toward the stripping member 30 as shown by an arrow B through the effect of the pushing force of the developing powder 19 conveyed on the sleeve 21 by the magnetic force of the magnet 22 and the rotation force of the sleeve 21.

The toner feeding bath 14 provides in itself a toner stirring roller 23, which rotates to feed the magnetic toner 13 into the developing bath 12. This toner stirring roller 23 includes as main components a supporting plate 36 fixed on a roller shaft 35, a forcing portion 23*a* mounted on one end portion of the supporting plate 26 and composed of a resin plate for pressing the magnetic toner 13 to the developing powder 19 for mixing at the toner outlet 16, and a breaking portion 23*b* mounted on the other end portion of the supporting plate 26 composed of a coil spring (not shown) for breaking the developing powder 19 pressed and fixed around the toner outlet 16.

The inhibiting member 26 is located between both ends of the toner outlet 16 of the developing bath 12 and both side walls 12*a* of the developing bath 12 and is mounted on the developing apparatus 17 itself along the line of the doctor 20 and the developing roller 18.

Figure 10:
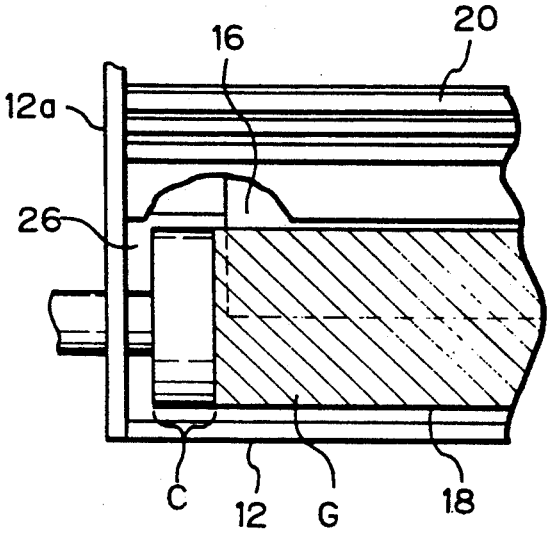
FIG. 10 is an elevation view showing the essential portion of the developing bath of FIG. 9.

The width of the inhibiting member 26 is the same as the length between the end of the toner outlet 16 and the side wall 12*a* of the developing bath 12. As shown in FIG. 10, the inhibiting member 26 is located a bit closer to the center of the developing roller 18 where the magnet 22 is provided rather than the non-imaging area C, that is, an empty area of the magnet 22 in the developing roller 18.

The interval d between the inhibiting member 26 and the sleeve 21 of the developing roller 18 is set as 1 mm.

The number of rotations of the sleeve 21 is 60 rpm, the number of rotations of the magnet 22 is 500 rpm, and the interval between the photoconductor 11 and the sleeve 21 is 0.35 mm.

The developing powder 19 is magnetically attracted on the sleeve 21 of the developing roller 18 in a manner that the developing powder 19 is laminated on the same width of the sleeve 21 as the width of the magnet 22. Then, the developing powder 19 is conveyed through the effect of the rotation of the sleeve 21 and the magnet 22 and is restricted to a proper amount. The restricted amount of the developing powder 19 is conveyed to the photoconductor 11 in which the development is carried out using the developing powder 19.

The developing powder 19 left on the sleeve 21 without transferring to the photoconductor 11 is stripped off the sleeve 21 by the stripping portion 32. The stripped developing powder 19 is blocked by the stripping portion 32 itself, and it results in causing the developing powder 19 to circularly flow toward the opening 33 through the rotation of the magnet 22 as shown by a circular flow A.

The toner feeding bath 14 serves to pressurize and feed the magnetic toner 13 toward the toner outlet 16 in a wavelike manner each time the forcing portion 23*a* and the breaking portion 23*b* rotate half round the toner stirring roller 23.

At the toner outlet 16, the magnetic toner 13 is mixed and stirred with the developing powder 19. Then, the resulting developing powder 19 is circularly flown toward the sleeve 21 through the lower portion of the opening 33 formed on the stripping member 30 by virtue of the magnetic force of the developing roller 18 and the conveying force of the sleeve 21.

The magnetic toner 13 is fed to the toner outlet 16 through the effect of the toner stirring roller 23 provided in the toner feeding bath 14. In a case that the developing powder 19 in the stirring area 31 keeps the toner density low, the magnetic toner 13 is attracted to the stirring area 31 by virtue of the magnetic force applied by the magnet 22.

In the stirring area 31, the circular flow A causes the developing powder 19 and the magnetic toner 13 to be stirred, it results in keeping the toner density to be a uniform as a predetermined value.

The resulting developing powder 19 is conveyed to the doctor 20 through the interval between the stripping portion 32 and the sleeve 21 through the effect of the rotation of the sleeve 21 and the magnet 22. The developing powder 19 is restricted by the doctor 20 so that the proper amount of the developing powder 19 is allowed to be conveyed to the photoconductor 11. The other amount of the developing powder 19 brings about the circular flow B so that the developing powder 19 is circulated toward the stripping portion 30 and again is stirred by the circular flow A.

Since the developing powder 19 is strongly conveyed by the magnetic force of the developing roller 18 and the rotation of the sleeve 21, the flow of the developing powder 19 (circular flow B) substantially forms no empty space in the upper portion of the second stirring area 34. The developing powder 19 is filled in and circularly flown into the second stirring portion 34 as if the developing powder 19 is pressurized.

The developing powder 19 is circulated counterclockwise as shown by the circular flow B in the second stirring area 34 so that the developing powder 19 meets the flow (circular flow A) of the developing powder 19 stripped off the sleeve 21 by the stripping member 30. Then, the developing powder 19 is last circulated to the toner outlet 16.

On the both end portions of the developing roller 18, where no image is taken, as shown in FIGS. 9 and 10, the inhibiting member 26 serves to inhibit the supply of the developing powder 19 onto the sleeve 21 so that no developing powder 19 is laminated on the end portions of the sleeve 21.

However, since the inhibiting member 26 is in non-contact with the sleeve 21, the rotation of the magnet 22 results in bringing about the toner dispersion to the sleeve 21. The thickness of the toner existing on the sleeve 21 is far smaller than the interval between the photoconductor 11 and the sleeve 21. Hence, no toner is attached to the photoconductor 11, that is, no toner gives dirt on the image.

The center-shifting end portions of the inhibiting member 26 meet the developing powder developing portion G of the sleeve 21. However, since the interval e between the doctor 20 and the sleeve 21 is larger than the interval d between the inhibiting member 26 and the sleeve 21 (see FIG. 6), the lamination of the developing powder 19 never results in contact between the inhibiting member 26 and the developing powder 19.

The toner on the sleeve 21 is moved only in a circumferential direction as being rotated in opposite direction to the rotation of the magnet 22.

In the present invention, by removing the obstacle (that is, keeping both ends of the developing roller 18 out of contact with anything), no longitudinal movement of the toner is allowed around the end portions of the developing roller 18, resulting in being able to improve the toner leaking phenomenon.

It was tested that 25,000 sheets of paper (corresponding to the life of the developing powder) was actually copied. The test reported no toner leakage caused around the end portions of the developing roller 18.

In turn, the description will be directed to the second embodiment of the developing apparatus according to the present invention with reference to FIGS. 11 to 15.

Figure 11:
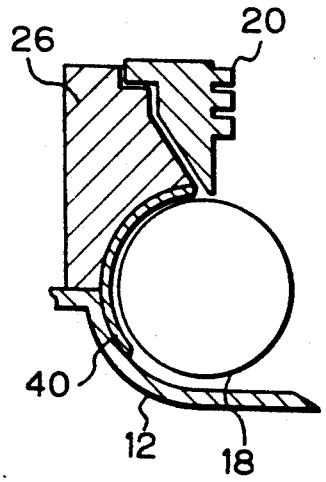
FIG. 11 is a sectional view showing a developing bath according to a second embodiment of the present invention.
Figure 12:
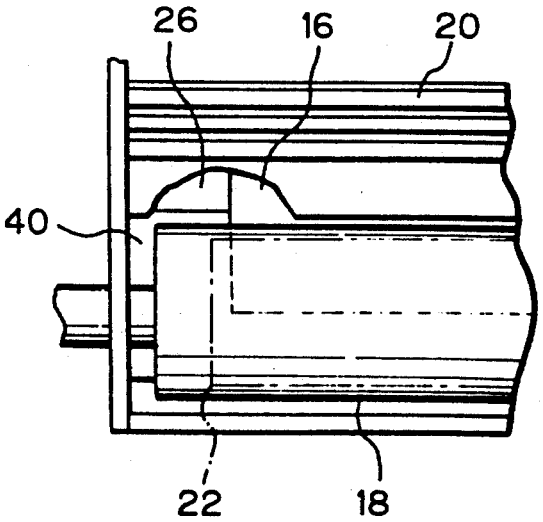
FIG. 12 is an elevation view showing the developing bath of FIG. 11.

As shown in FIGS. 11 and 12, the developing apparatus according to the second embodiment provides an iron plate 40 fitted on the surface of the inhibiting member 26 to which the developing roller 18 is opposed. Since the iron plate 40 is made of magnetic substance, the magnetic force of constraint is made higher, resulting in more effectively inhibiting the movement of the developing powder 19 against the side walls 12*a* of the developing bath 12.

The iron plate 40 is as thick as 0.5 mm and is attached on the overall surface of the developing roller 18 of the inhibiting member 26 in non-contact with the developing roller 18.

The other arrangement of the second embodiment is the same as that of the first embodiment. Hence, the detailed description of the same arrangement will be left out.

Figure 15:
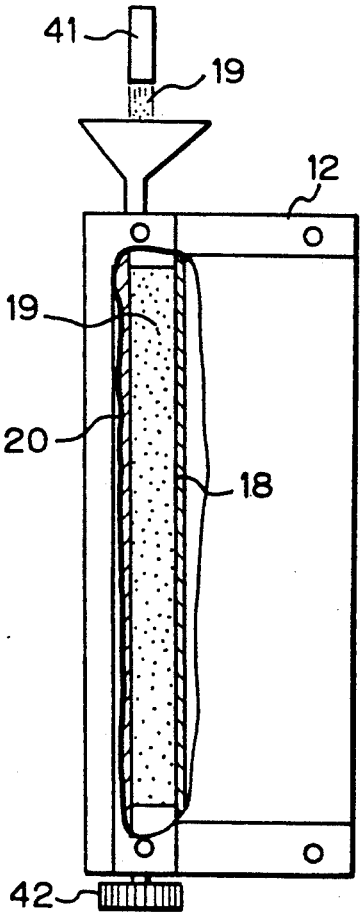
FIG. 15 is a plane view showing a developing bath in which developing powder is filled.

In FIG. 15, 41 denotes a developing powder filling machine and 42 denotes a developing roller driving gear.

Figure 13:
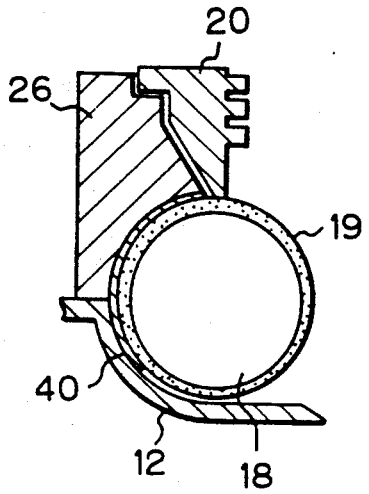
FIG. 13 is a sectional view showing the developing bath having the developing roller on which the developing powder is laminated.
Figure 14:
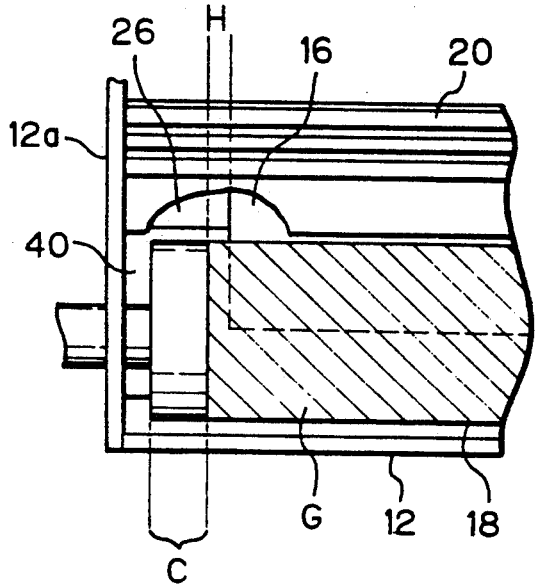
FIG. 14 is an elevation view showing an essential portion of the developing bath of FIG. 13.

Turning to FIGS. 13 and 14, on an H portion where the magnet 40 is overlapped with a portion (developing powder laminating portion G of the magnet 22 provided inside of the developing roller 18), the developing powder 19 is strongly attracted by the line of magnetic force directed from the magnet 22 to the magnet 40. As shown in FIG. 15, therefore, when the developing powder filling machine 41 fills the developing bath 12 with the developing powder 19 and when the wrapped developing apparatus is fallen or shaken in transportation, the inner pressure is often applied to the developing powder 19. However, the constraint force given by the magnet 40 serves to stop the movement of the developing powder 19 toward the side walls 12*a* of the developing bath 12 against the inner pressure. It results in preventing the leakage of the developing powder 19 when the developing powder 19 is filled or the developing apparatus is fallen or shaken.

It was tested that the wrapped developing apparatus was fallen from a height of 1.5 m and collided on the ground at the ten portions (one corner, three edges, and six surfaces) of the apparatus itself. No leakage was found of the developing powder 19 to the end portions of the developing roller 18.

Many widely different embodiments of the present invention may be constructed without departing from the spirit and scope of the present invention. It should be understood that the present invention is not limited to the specific embodiments described in the specification, except as defined in the appended claims.

What is claimed is:

1. A developing apparatus capable of preventing a leakage of developing powder from being placed on a photoconductor of a copying machine, comprising:

means for storing a developing powder;

a roller having a sleeve and a magnet, said roller being rotationally supported on said storing means for laminating said developing powder output from said storing means on said sleeve in accordance with a magnetic force of said magnet;

a doctor for restricting the amount of developing powder to be transported on said sleeve to a preselected thickness to be placed on a surface of said photoconductor; and means for preventing said developing powder from being leaked to a non-imaging area located at end portions of said roller, said preventing means being located upstream of said doctor in said storing means relative to the rotation of said roller and being so arranged as to provide a curved surface which faces said roller and which is spaced from said roller by a distance which is larger than the spacing between said doctor and said roller, thereby to avoid contact with any developing powder on said non-imaging areas.

2. A developing apparatus according to claim 1, wherein said apparatus further comprises a toner feeding bath disposed adjacent to said storing means for feeding a magnetic toner, said toner feeding bath having a toner outlet which communicates said storing means with said toner feeding bath for flowing said magnetic toner.

3. A developing apparatus according to claim 2, wherein said apparatus further comprises a stripping member located between said toner outlet and said doctor, said stripping member being mounted at the bottom of said outlet and having an upstanding perforate portion through which developing powder can circulate and, supported by said upstanding portion, an elongate stripping element which extends laterally from said upstanding portion toward said sleeve for stripping off said developing powder placed on said sleeve so that said magnetic toner is mixed with said developing powder.

4. A developing apparatus according to claim 3, wherein said stripping element is located in a rotation downstream side of said sleeve more than said toner outlet and before said doctor.

5. A developing apparatus according to claim 4, wherein the lower portion of said perforate portion is bent and the lower bent end thereof is mounted on said developing apparatus at a lower portion of said toner outlet.

6. A developing apparatus according to claim 5, wherein the spacing between said stripping portion and said sleeve is $0.7 \pm 0.1$ mm and said interval between said doctor and said roller is $0.30 \pm 0.02$ mm.

7. A developing apparatus according to claim 1, wherein said storing means has walls and said preventing means has a surface made of a magnetic material so that a magnetic force of constraint inhibits a movement of said developing powder to said walls of said storing means.

8. A developing apparatus according to claim 7, wherein said surface of said preventing means includes an iron plate attached thereon for magnetizing said surface.

9. A developing apparatus according to claim 1, wherein said developing apparatus further comprises a first stirring area defined by said stripping member and said sleeve, said stirring area being so arranged that said stripped developing powder and said magnetic toner are stirred therein for mixing said stripped developing powder and said magnetic toner, said magnetic toner being newly fed from said toner feeding bath through an effect of a circular flow caused by said magnet.

10. A developing apparatus according to claim 9, wherein said developing device further comprises a second stirring area defined by said doctor and said sleeve, said second stirring area serving to cause a circular flow directed to said stripping member along a rotation of said sleeve through an effect of said magnetic force of said magnet and a rotation of said sleeve.

11. A developing apparatus according to claim 1, wherein said storing means is a developing bath, said roller is a developing roller, and said preventing means is an inhibiting member.

* * * * *